United States Patent [19]

Maeda et al.

[11] 3,942,348

[45] Mar. 9, 1976

[54] CUTTER DIES FOR THE CROSS ROLLING MACHINE

[75] Inventors: Nobutaka Maeda, Hiroshima; Hidehiko Tsukamoto, Saiki, both of Japan

[73] Assignee: Mitsubishi Jukogyo Kabushiki Kaisha, Tokyo, Japan

[22] Filed: Oct. 15, 1974

[21] Appl. No.: 514,909

[30] Foreign Application Priority Data

Nov. 6, 1973 Japan ..... 48-124000

[52] U.S. Cl. ..... 72/71

[51] Int. Cl.[2] ..... B21H 8/02

[58] Field of Search ..... 72/70, 71

[56] References Cited

UNITED STATES PATENTS

| | | | |
|---|---|---|---|
| 3,176,491 | 4/1965 | Mau et al. | 72/71 |
| 3,602,025 | 8/1972 | Awano et al. | 72/71 |
| 3,611,769 | 10/1972 | Hencl | 72/71 |

*Primary Examiner*—Lowell A. Larson

*Attorney, Agent, or Firm*—Toren, McGeady and Stanger

[57] ABSTRACT

Cutter dies for cross rolling machines, each of which dies consisting of a shaping surface and a finishing surface, the width of the shaping surface being increasingly smaller and its height larger towards the end portions of the shaping surface, characterized in that the width of the shaping surface is further increased in the end portions of the cutter dies from a preferred position in an angle substantially less than 15° from the end portions of the cutter dies.

6 Claims, 17 Drawing Figures

FIG.5
PRIOR ART
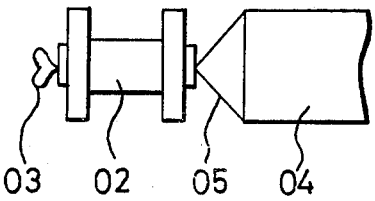
FIG.6
PRIOR ART
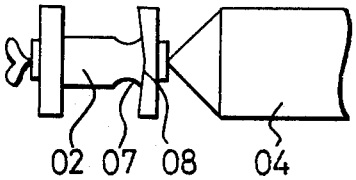
FIG.7 PRIOR ART
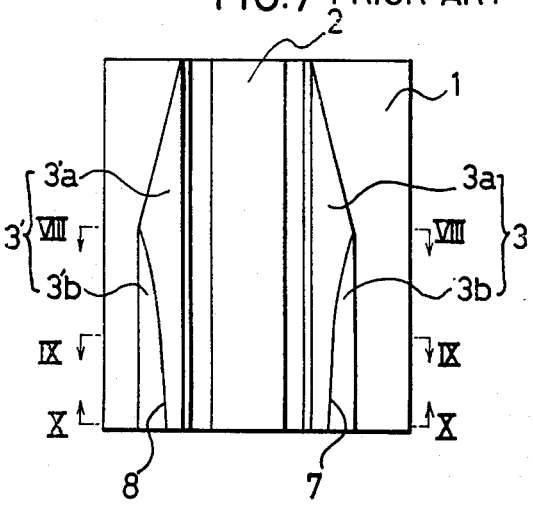
FIG.8 PRIOR ART
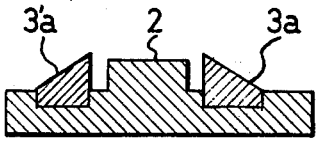
FIG.9 PRIOR ART
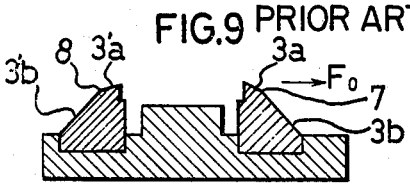
FIG.10 PRIOP ART
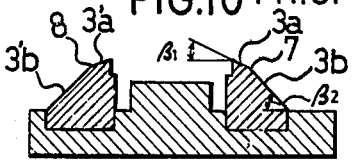
FIG.11 PRIOR ART
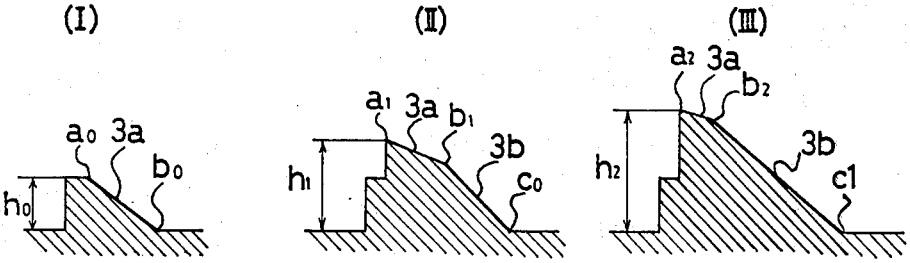

CUTTER DIES FOR THE CROSS ROLLING MACHINE

BACKGROUND OF THE INVENTION

This invention relates to improvements in cutter dies for the cross rolling machine.

The cross rolling machine for rolling and shaping a graduated shaft is conventionally constructed as illustrated in FIGS. 1 and 2. As seen in the figures, W denotes a shaped bar material; 01, 01′ a pair of rolls mounted in parallel on two shafts and rotatable from a preferred drive source in the same direction and at same speed; 01*a*, 01′*a* rolling dies of a wedge shape provided on the outer peripheral surfaces of the rolls 01, 01′; and 01*b* 01*c*, 01′*c* 01′*b* cutter dies fixed on the outer peripheral surfaces of the rolls 01, 01′ on both sides of each of the wedge-shape rolling dies 01, 01′. A given heated bar material W may be inserted between the rolls 01, 01′ which may be rotated at the same speed in the direction of the arrows in the figure. The material W is compressed and rolled between the rolling dies 01*a*, 01′*a* and formed into a desired shape, and then cut off by the cutter dies 01*b*, 01′*b* 01*c*, 01′*c* finally taken out as a finished product. The remaining bar material may be inserted between the rolls 01, 01′ through mechanical elements not shown and subjected to a subsequent rolling and shaping operation. In the same manner as described above, a bar material experiencing compression and rolling between the rolling dies 01*a*, 01′*a* and further cut off by the cutter dies 01*b*, 01′*b* 01*c*, 01′*c*, which is likewise formed into a product. These operations can be repeated continuously for rolling and shaping. The above described cutter dies 01*b*, 01*c* and 01′*b*, 01′*c* (cutter 01′*c* is not shown) are formed as shown in a developed view of FIG. 3 and a transverse view of its end portion as shown in FIG. 4, respectively (Cutter dies 01′*b*, 01′*c* are substantially identical as 01*b*, 01*c* and therefore not shown). Thus, it is provided that a product 02 and a long bar material 04 are cut off by the cutter dies 01*b*, 01′*b* and the product 02 and the remaining portion 03 in the forward end of the material are cut off by the cutter dies 01*c*, 01′*c* (Refer to FIG. 5). In this instance, formation of a service hole in the forward end 05 can be avoided by preforming an end 05 of a long bar material 04 into a conical shape as shown in FIG. 5, which end portion is provided with an excess portion. For this purpose, the end portions of the cutter dies 01*b*, 01′*b* have in their transverse sectional surfaces angles $\beta$ as shown in FIG. 4. Preferably the angle $\beta$ may be 15°–70° and particularly 45° as heretofore considered appropriate.

However, in the above prior art cutter dies, the cutter dies are provided to cut into a bar material so that, when the material is cut off slowly, the oblique shaping surfaces of the cutter dies tend to extend gradually so deep as to reach the central part of the material to cause the shaping force F to act ever increasingly on the bar material. This resulted in that, as shown in FIG. 6, the product had a deficiency 07 in the shaft portion of the product 02 or a deficiency 08 inside the stepped section of the product. Hitherto, this drawback was compensated by forming the product slightly larger in diametrical dimensions than desired, such compensation partly bringing bad yield in the product. The same also applied to the case of the cutter dies 01*c*, 01′*c*.

To overcome the drawback in the conventional cutter dies, the inventors have proposed novel cutter dies for the cross rolling machine, which construction is characterized in that a cutter die consists of a shaping surface and a finishing surface and the shaping surface may have its width increasingly smaller and the height larger closer toward the end portion of the shaping surface.

Formation of the described shaping surface may be illustrated with reference to the accompanying drawings, particularly to FIGS. 7–12.

In FIG. 7, numeral 1 denotes rolls, 2 end portions of wedge-shaped rolling dies attached to the outer peripheral surfaces of the rolls, 3 cutter dies on the outer peripheral surfaces of the rolls 1 on the outside of one of the rolling die end portions 2, and 3′ cutter dies on the outer peripheral surfaces of the rolls 1 on the outside of the other of the rolling die end portions. The cutter dies 3 serve to cut off the product 02 from the bar material 04 and the cutter dies 3′ cut off the product 02 from the remaining portion 03 in the forward end of the bar material respectively. Each of the cutter dies 3 are constituted by a shaping surface 3*a* and a finishing surface 3*b*, which are connected by a zenith line 7, and each of cutter dies 3′ are constituted by shaping surface 3′*a* and finishing surface 3′*b* connected by a zenith line 8, respectively. The above-mentioned zenith lines 7, 8 are moderately sloping curves more inclined closer to the wedge-shape dies 2, nearer the end portions of the cutter dies 3, 3′. That is, the width of shaping surfaces 3*a*, 3′*a* become increasingly smaller toward the end portions of the cutter dies 3, 3′ and the finishing surfaces 3*b*, 3′*b* are formed to have their width increasingly larger. The shaping surfaces 3*a*, 3′*a* also may have their height increasingly larger in the end portions of the cutter dies 3. As shown in the enlarged views of FIG. 11, (I), (II), and (III), the shaping surface 3*a* may have the width increasingly smaller as shown respectively by $a_0$–$b_0$, $a_1$–$b_1$, and $a_2$–$b_2$ closer to the end portion of the cutter dies. The height of the cutter dies is formed increasingly greater as shown respectively by $h_0$, $h_1$, and $h_2$ also closer to the end portions of the cutter dies. The above described shaping surface 3*a* is deeply cut into the central part of the material while shaping the bar material during rolling and shaping operation to accomplish the cutting and separation of the material 04 and the product 02. The shaping is thus achieved by the shaping cutter substantially in contact with the material and taking a part of the material to be transferred.

The finishing surface 3*b*, on the other hand, as shown in FIG. 11, (I), (II), and (III), may have increasingly larger widths closer to the end portions of the cutter dies 3 as shown by $b_0$, $b_1$–$c_0$, and $b_2$–$c_1$ respectively at points on the material. This finishing surface 3*b* can not serve to transfer volume of the material during rolling and shaping of the material. The shaping surface 3*a* is finished up in the way slightly contacting the surface shaped by the described shaping surface 3*a*. The angles $\beta_1$, $\beta_2$ made respectively on the inclined surfaces of the shaping surface 3*a* and the finishing surfaces 3*b* may normally be 15° to 70°. Experiment provided 25° for $\beta_1$ and 45° for $\beta_2$ respectively which were taken most appropriate for the angles. In the similar way, the angle of inclination in the shaping surface 3′*a* and the finishing surface 3′*b* may be adequately selected. Although omitted from the drawings, the cutter dies of the same construction as above described may be likewise provided in the other rolls of the cross rolling machine.

The cutter dies as conventionally proposed and having the construction as above described are arranged such that the product 02 and the bar material 04 can be rolled and shaped with a pair of rolls into a stepped shaft with flanged parts and they are cut off separately. The shaping surfaces 3*a* of the cutter dies 3 are slowly cut into the material. The product 02 and the bar material 04 are cut off separately on the shaping surface 3*a*. In this instance, the material is extended outwardly to balance with the shaping force $F_0$ (FIG. 9) of the shaping surfaces 3*a* in an amount corresponding to the volume of cutting of the shaping surface 3*a* deep into the material. On the other hand, the finishing surface 3*b* provides finishing only in the shaping surface 3*a* without transferring the volume of the material while the shaping force produced from the finishing surface 3*b* is acting upon the bar material. Accordingly, the shaping force $F_0$ is so greatly reduced as compared with the conventional cutter dies so that the product may not have a deficiency in the surface as heretofore encountered.

The above description also applies to the shaping surface 3'*a* and the finishing surface 3'*b* as well.

The inventors have thus manufactured a number of stepped shaft products by use of the described cutter dies for the cross rolling machine. After continued manufacture of products, a disadvantage was found in the cutter dies in that the spring shaping surface of the cutter dies ($a_2$–$b_2$, particularly $a_2$ in FIG. 11 (III) ) would wear out gradually and the separation of the product from the material was not achieved effectively.

This disadvantage can be removed by the inventors in an attempt to surely separate the product from the material even when any wear would remain in the cutter dies.

SUMMARY OF THE INVENTION

According to the invention, the cutter dies are obtained in such a way that the shaping surface of the cutter dies increases along the length of the dies during the finishing operation starting from the end portions of the dies where an angle of 10° to 15° is made on the shaping surface, thereby applying a tension force in the axial direction. Thus, in the obtained cutter dies, the material and the product can be surely cut off separately even when the cutter dies wear out and such cutter dies may not sufficiently cut into the central part of the material.

BRIEF DESCRIPTION OF THE DRAWING

Other objects and features of the invention will be made apparent from the description given by way of example with reference to the accompanying drawings, in which:

FIGS. 3–11 are diagrams illustrating the construction and function of the conventional cutter dies, of which FIG. 3 is a developed view of the conventional cutter dies;

FIG. 4 is a sectional view taken along the line IV—IV of FIG. 3;

FIGS. 5 and 6 are views illustrating the separation of the shaped products;

FIG. 7 is a further developed view of the conventional cutter dies;

FIGS. 8–10 are sectional views respectively taken along the lines VIII—VIII, IX—IX, and X—X of FIG. 7;

FIG. 11 (I)–(III) are partially enlarged views of FIGS. 8 to 10;

FIG. 13 is a view taken along the line XIII—XIII of FIG. 12;

FIG. 14 is a view taken along the line XII—XII of FIG. 12;

FIG. 15 is a view taken along the line XI—XI of FIG. 12;

FIG. 16 is a partially enlarged view of FIG. 15; and

FIG. 17 is a view illustrating the separation of the shaped product.

DETAILED DESCRIPTION OF THE INVENTION

The embodiment of the invention is now illustrated in more details with reference to FIGS. 12 to 17.

Figure 1:
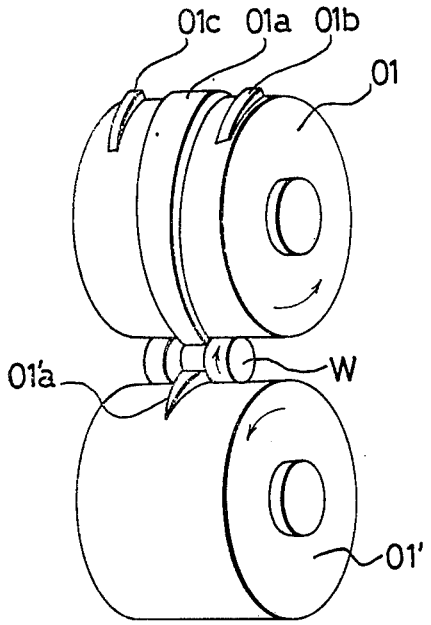
FIG.1 PRIOR ART
FIGS. 1 and 2 are diagrams illustrating the cross rolling machine.
Figure 2:
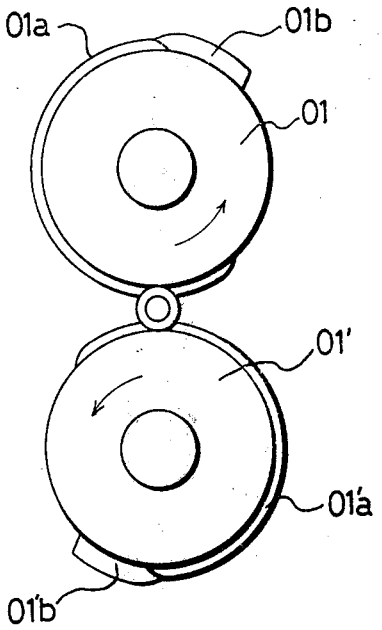
FIG.2 PRIOR ART
Figure 3:
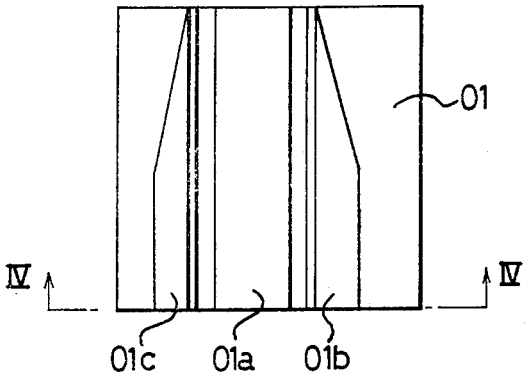
FIG.3 PRIOR ART
Figure 4:
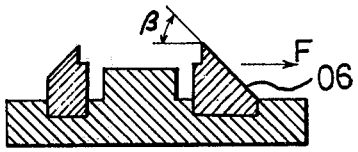
FIG.4 PRIOR ART
Figure 12:
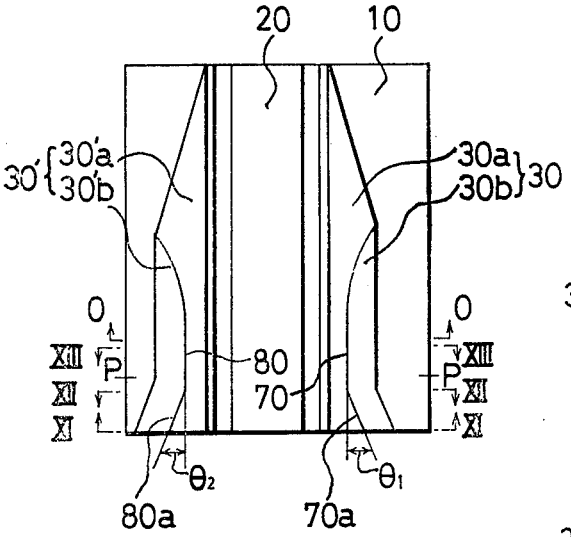
FIGS. 12–17 illustrate an embodiment of the cutter dies according to the invention.
Figure 13:
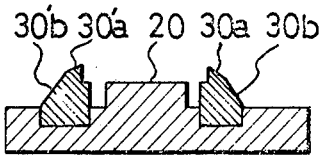
Figure 14:
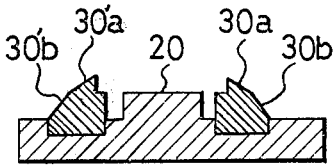

In FIG. 12, numeral 10 denotes rolls; 20 wedge-like dies fixed on the outer periphery of the rolls 10; 30 cutter dies attached to the rolls 10 on the outside at the end of the dies 20; and 30' cutter dies attached to the outer peripheral surfaces of the rolls on the outside.

Figure 17:
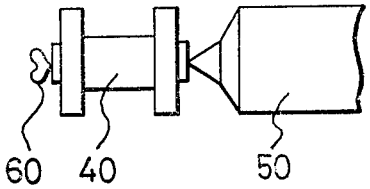

The cutter dies 30, as shown in FIG. 17, serve to cut off the product 40 from the bar material 50, and the cutter dies 30' to cut off the product 40 from the remaining portion 60 at the end of the material.

The cutter dies 30 are formed with the shaping surface 30*a* and the finishing surface 30*b* connected by a zenith line 70. The cutter dies 30' are formed with the shaping surface 30'*a* and the finising surface 30'*b* connected by a zenith line 80. These zenith lines 70, 80 are formed in moderate curves with the wedge-shape dies closer to the end portions of the cutter dies 30, 30'. The zenith lines 70, 80 are formed in a definite shape (5°–10° in the angle of rolling dies) by a levelling-off operation and thereafter formed in a substantially straight line toward the outside of the wedge-shape dies 20 at a point 10°–15° less in angle from the end portions of the cutter dies (Refer to FIGS. 12–15). Width of the shaping surfaces 30*a*, 30'*a* is gradually smaller beginning from the end portions of the cutter dies 30, 30' until a point about 20° (line 0—0 in FIG. 12) less in angle from the end portions of the cutter dies 30, 30' and the width of the finishing surfaces 30*b*, 30'*b* is formed gradually larger, while the shaping surfaces 30*a*, 30*b* being gradually higher.

The cross section on the line 0—0 is continued to the line P—P about 10° less in angle from the end portions, where finishing is performed. Normally the height of the cutter dies is determined such that in the above-mentioned points the product 40 is cut off from the material 50 and the product 40 is cut off from the remaining end portions 60.

Figure 15:
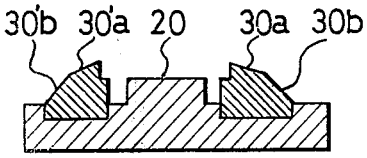
Figure 16:
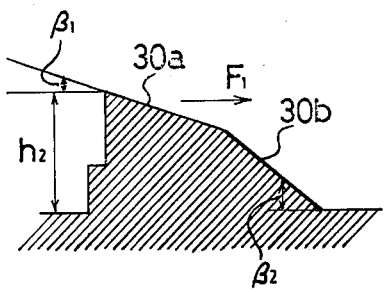

The shaping surfaces 30*a*, 30'*a* are increased greatly at a point just passing over the line P—P about 10° less in angle from the end portions of the cutter dies as shown in FIGS. 15 and 16. The finishing surfaces 30*b*, 30'*b* also are increased in width. For this reason, the shaping surfaces 30*a*, 30'*a* impart a radical axial force $F_1$, which is not imparted to the shape formed up to the P—P line. By the action of this axial force, the product 40 is surely cut off from the bar material 50 and the product 40 from the remaining end portions 60. The angles $\theta_1$, $\theta_2$ (in FIG. 12) in the shaping surfaces 30*a*, 30'*a* are preferably less than 10° (5°–10°). Larger angles are also available for the separation of the material 50 or the remaining portions 60, in which, however, the product 40 and the material 50 may be unstable and difficult to make precise finishing.

The cutter dies according to the invention thus can eliminate the drawback of the conventional cutter dies in which sure separation of the products from the bar material and the product from the remaining end portions may not be obtained due to wear in the shaping surfaces of the cutter dies from continuous shaping operation. Undesirable effects such as the deficiency in the end portions of the product may be avoided which may badly affect the rolling and shaping operation by a radical increase of the shaping surface and the axial force at the point 10° from angle in the end portions of the cutter dies.

The obtained cutter dies are able to achieve a desired practical result by use of the cross rolling method and adapted for a precise and large-scale production.

In the cutter dies according to the invention, the position of increase in the width of the shaping surfaces would vary depending on the axial diameter of the product but such position may be determined preferably at 15° or less in angle from the end portions of the cutter dies.

The invention is not limited only to the rolling and shaping method as referred to above and shown in the accompanying drawings but it may also be applcable in the cutter dies for the cross rolling machine such as fixed on plane surfaces, if the spirit of the invention is maintained for the practice of the invention.

What we claim is:

1. Cutter dies for cross rolling machines, each of said dies comprising a shaping surface, a finishing surface, a beginning portion, and an end portion, a first portion of said shaping surface having a width and height decreasing and increasing, respectively, along a portion of said cutter die from said beginning portion to a point near said end portion, and a second portion of said shaping surface having a width and height increasing and decreasing, respectively, along the portion of said cutter die from said point to said end portion.

2. Cutter dies according to claim 1, wherein said first portion comprises a part thereof whose width remains approximately constant up to said point.

3. Cutter dies according to claim 2, wherein said finishing surface has a first portion, the width of said first portion of said finishing surface increasing from said beginning portion to said point.

4. Cutter dies according to claim 3, wherein said finishing surface has a second portion, said second portion of said finishing surface extending at an angle relative to said first portion of said finishing surface, said angle being determined by the intersection of a center line of said part of said first portion of said finishing surface and a center line of said second portion of said finishing surface.

5. Cutter dies according to claim 4, wherein said angle is between 5 degrees and 10 degrees.

6. Cutter dies according to claim 1, further comprising a roller, two of said cutter dies being supported on said roller in parallel relation to each other, and said roller comprises a wedged-shaped rolling die parallel with and separating said two cutter dies, the finishing surfaces of said cutter dies lying a farther distance away from the respective edges of the said wedged-shaped rolling die than the respective shaping surfaces.

* * * * *